US009481002B2

(12) United States Patent
Allers

(10) Patent No.: US 9,481,002 B2
(45) Date of Patent: Nov. 1, 2016

(54) DEVICE FOR MANUALLY PAINTING A LARGE SURFACE, IN PARTICULAR AN OUTER SURFACE OF AN AIRCRAFT

(71) Applicant: Airbus Operations GmbH, Hamburg (DE)

(72) Inventor: Jens Allers, Jork (DE)

(73) Assignee: Airbus Operations GmbH (DE)

( * ) Notice: Subject to any disclaimer, the term of this patent is extended or adjusted under 35 U.S.C. 154(b) by 371 days.

(21) Appl. No.: 13/769,983

(22) Filed: Feb. 19, 2013

(65) Prior Publication Data

US 2013/0214067 A1 Aug. 22, 2013

Related U.S. Application Data

(60) Provisional application No. 61/601,642, filed on Feb. 22, 2012.

(30) Foreign Application Priority Data

Feb. 22, 2012 (DE) ..... 10 2012 003 372

(51) Int. Cl.
*B05B 15/06* (2006.01)
*B05B 15/08* (2006.01)
*B05B 7/24* (2006.01)

(52) U.S. Cl.
CPC ..... *B05B 15/08* (2013.01); *B05B 15/064* (2013.01); *B05B 7/2402* (2013.01)

(58) Field of Classification Search
CPC ..... B05B 1/28; B05B 15/06; A62C 31/02
USPC ..... 239/532, 528, 530, 526, 289, 525, 527, 239/290, 296, 300, 390, 397, 414, 280.5
See application file for complete search history.

(56) References Cited

U.S. PATENT DOCUMENTS

| | | | | |
|---|---|---|---|---|
| 1,605,185 | A | 11/1926 | Heinrich | |
| 3,648,396 | A * | 3/1972 | Smith | 42/94 |
| 4,023,711 | A * | 5/1977 | Sena | B05B 15/064 222/174 |
| 4,411,387 | A * | 10/1983 | Stern et al. | 239/345 |
| 4,540,943 | A * | 9/1985 | Akers | 324/326 |
| 4,546,922 | A | 10/1985 | Thometz | |

(Continued)

FOREIGN PATENT DOCUMENTS

| | | |
|---|---|---|
| DE | 2230148 A1 | 1/1974 |
| DE | 69622298 T2 | 2/2003 |

(Continued)

*Primary Examiner* — Arthur O Hall
*Assistant Examiner* — Christopher R Dandridge
(74) *Attorney, Agent, or Firm* — Lerner, David, Littenberg, Krumholz & Mentlik, LLP

(57) ABSTRACT

A device for manually painting a large surface using a spray gun connected to a paint feed line for the supply of an enamel paint and to a pressure line for the provision of compressed air. After the manual actuation of an operating switch arranged on a handle piece, the spray gun sprays the enamel paint by compressed air via a spray head to apply the enamel paint onto the surface. The spray gun includes means such that it can be moved manually along the surface. The means include an extension rod, at one end of which the spray gun is attached by the handle piece and which is configured such that, when held by an operator on an arm holder configured at the opposite end, it extends from the elbow along the forearm of the operator and beyond the distal end of the forearm.

9 Claims, 1 Drawing Sheet

(56) References Cited

U.S. PATENT DOCUMENTS

| | | | | |
|---|---|---|---|---|
| 5,236,129 | A * | 8/1993 | Grime et al. | 239/528 |
| 5,725,161 | A | 3/1998 | Hartle | |
| 6,070,809 | A * | 6/2000 | Price | 239/273 |
| 6,522,039 | B1 | 2/2003 | Baltz et al. | |
| 6,547,165 | B2 * | 4/2003 | Goodwin | B05B 12/00 239/280 |
| 6,845,923 | B1 * | 1/2005 | Slotsve | 239/376 |
| 6,976,644 | B2 * | 12/2005 | Troudt | B05B 15/066 239/525 |
| 7,252,210 | B1 * | 8/2007 | Schultz | B65D 83/203 222/174 |
| 2006/0124782 | A1 * | 6/2006 | Matsumoto et al. | 239/706 |
| 2007/0122227 | A1 | 5/2007 | Davis | |

FOREIGN PATENT DOCUMENTS

| | | | | |
|---|---|---|---|---|
| DE | 102008000397 | A1 | 8/2009 | |
| EP | 0847807 | A2 | 6/1998 | |
| WO | WO9106376 | * | 5/1991 | B05B 5/03 |
| WO | 2012/012521 | A1 | 1/2012 | |

* cited by examiner

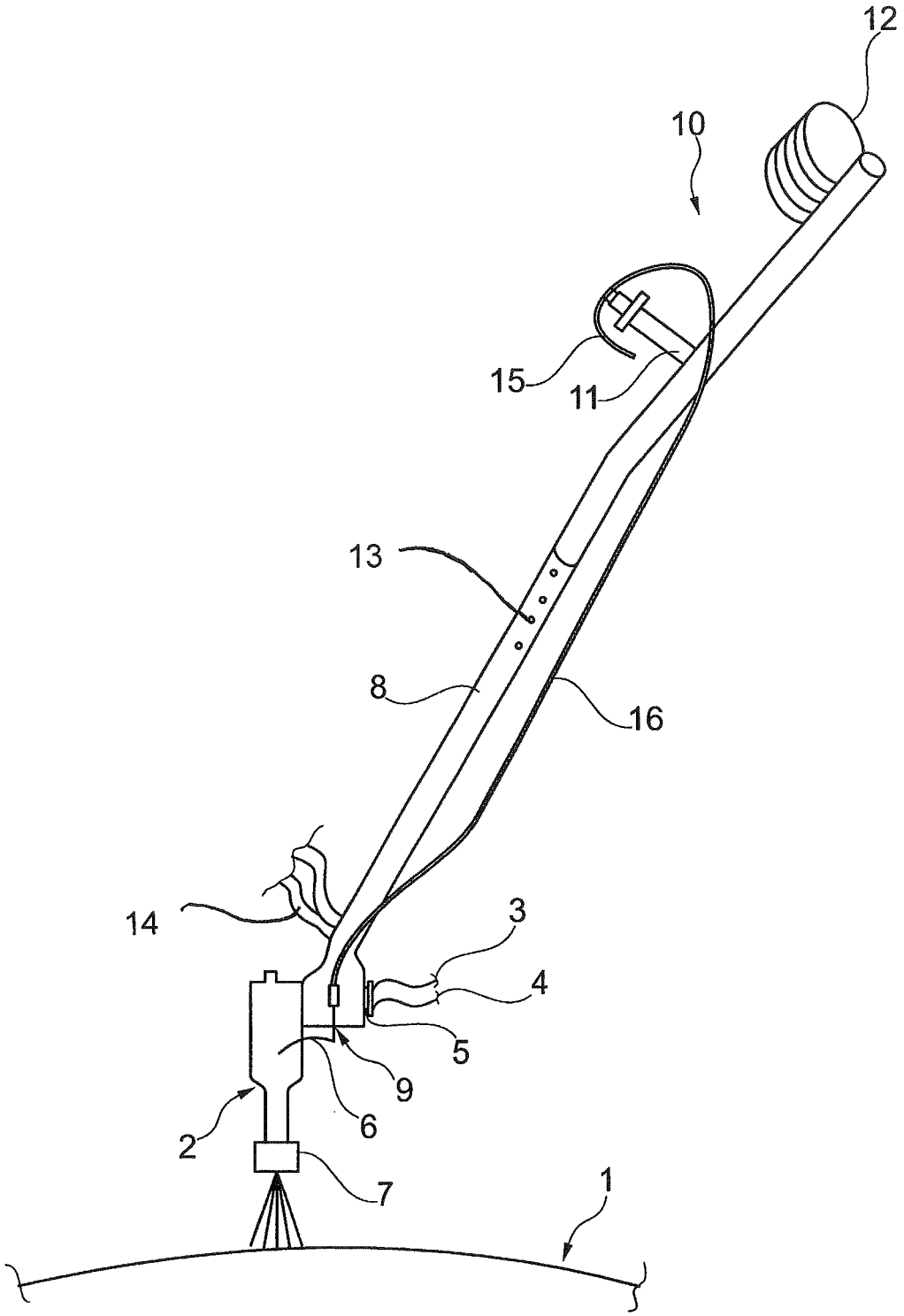
12
10
15
11
13
8
16
14
3
4
5
9
6
2
7
1

DEVICE FOR MANUALLY PAINTING A LARGE SURFACE, IN PARTICULAR AN OUTER SURFACE OF AN AIRCRAFT

CROSS-REFERENCE TO RELATED APPLICATIONS

This application claims the benefit of the filing date of U.S. Provisional Patent Application No. 61/601,642 filed Feb. 22, 2012, the disclosure of which is hereby incorporated herein by reference.

FIELD OF THE INVENTION

The invention relates to a device for manually painting a large surface, in particularly an outer surface of an aircraft, using a spray gun which is connected to a paint feed line for the supply of an enamel paint and also to a pressure line for the provision of compressed air and which, after the manual actuation of an operating switch arranged on a handle piece, sprays the enamel paint by compressed air via a spray head to apply the enamel paint onto the surface, the spray gun being provided with means such that it can be moved manually along the surface.

The field of application of the invention extends to spray guns, spray lances or other manually guided painting devices which are used to coat surfaces with enamel paint. Enamel paint is sprayed by compressed air into small drops by means of a conventional spray gun. The drops are deposited on the sprayed workpiece and there form a superficial film, when applied in sufficient quantities.

The production of the pressure difference, required for spraying the enamel paint, at the spray head of the spray gun and the feed of the enamel paint to the spray gun can be carried out in different ways. In industrial applications of the type of interest here, electrostatic paint application devices are being used to an increasing extent, in which devices the stream of enamel paint, sprayed from the spray gun, is charged electrostatically to apply it uniformly over the surface which has been charged in a corresponding manner. The effect of the electrostatic charge is to draw the sprayed paint over the surface of the workpiece.

BACKGROUND OF THE INVENTION

EP 0 847 807 A2 discloses an electrostatic paint application device. In this case, a low-voltage source, accommodated in an explosion-proof housing, having an electric generator is arranged remotely from a spray gun. The low-voltage source is connected to the housing of the spray gun by a low-voltage cable. The low-voltage source is suited to being accommodated in a spray booth and in a hangar in which an aircraft is painted with the enamel paint. The spray gun has three external connections. In addition to the low-voltage cable, the spray gun is connected to a compressed air hose and to a paint hose. The compressed air hose is connected to a conventional compressed air source, namely a compressor. The paint hose is connected to a pressurised paint tank which contains the enamel paint. When a person operating the spray gun presses a switch on the spray gun, an air valve of the spray head is opened to release a flow of sprayed air. In connection therewith, a paint valve which is also arranged on the spray head is opened to release a flow of paint.

The low-voltage cable applies a low direct voltage to the spray gun. The voltage can be at a controlled level of between 0 and 10 volts of direct current. This voltage is applied to the input of a conventional high-voltage source which is inside the spray gun. The high-voltage feed contains an oscillator which converts the input direct voltage into an alternating voltage at a higher level. The alternating voltage is then applied to a capacitor and diode network which multiplies the voltage and converts it into a direct voltage at a very high level, as is generally known in the prior art. The actual level of the voltage depends on the level of the input direct voltage. Adjusting the level of the applied direct voltage at the low-voltage cable adjusts the level of the high voltage which causes the electrostatic painting.

DE 10 2008 000 397 A1 describes a conventional spray gun which, in its basic structure, is similar to the spray gun described above, but which works without electrical means for electrostatically charging the jet of paint. A conventional spray gun of this type is also capable of being used within the scope of the device according to the subject-matter of the invention.

A disadvantage of known spray guns is that they are operated manually along the surface by a handle piece which is arranged near the operating switch of the spray gun, so that surfaces of aircraft parts which are particularly low-lying and are directed obliquely downwards can only be reached with a considerable amount of physical effort. Such working conditions are tiring and in the long run are harmful to health. In the general prior art, solutions are already known in which the spray head of a spray gun is configured as a type of lance, so that the spray head is arranged at a relatively great distance from the other components of the spray gun. However, this solution cannot produce paintwork of a satisfactory quality, since on the one hand, an electrostatic charge of the enamel paint is not ensured and on the other, the guidance of the spray head cannot be manually controlled in an adequately precise manner.

An aspect of the present invention provides a device for manually painting a large surface using a spray gun, which device allows an ergonomically improved handling of the spray gun, in particular for painting low-lying and downwardly directed surfaces of aircraft parts, the device not impairing the quality of the paintwork.

BRIEF SUMMARY OF THE INVENTION

An aspect of the invention comprises the technical teaching that means for manually moving a spray gun along the surface comprise a special extension rod, at one end of which the spray gun is attached by the handle piece and which is configured such that, when held by an operator on an arm holder, configured on the opposite end, said extension rod extends from the elbow along the forearm of the operator and beyond the distal end of the forearm.

The advantage of the solution according to an aspect of the invention is in particular that a conventional spray gun can be used which can be fitted with the device according to the invention in order to reach the aforementioned problematic large-surface sites. Due to the special arm holder, it is possible to achieve high-quality paintwork, because the movement of the spray gun can be manually controlled in a precise manner by this arm holder and in cooperation with the extension rod.

To improve handling, it is proposed that the arm holder of the extension rod comprises a handle which extends away from the extension rod in a substantially vertical direction. The operator can comfortably grasp this handle in order to move the extension rod backwards and forwards or also to twist it, thereby ensuring a precise guidance along the surface to be painted.

To further improve the ergonomics, it is proposed that the arm holder is fitted at the end with an arm support to at least partially surround the forearm of the operator. This measure enhances the stability of the movement sequences and the operator senses that the device according to the invention is a type of artificial extension of the forearm, to comfortably reach the problematic areas of the surface to be painted.

A further measure of the present invention proposes that the extension rod comprises at the end associated with the spray gun a clip-like fastening unit for releasable attachment to the handle piece of the spray gun. As a result of this measure, a conventional spray gun with a handle can be used, which can be fitted with the device according to the invention via the clip-shaped fastening unit. In addition to this, it is also possible to releasably attach the fastening unit to the handle piece of the spray gun by clamping or screwing it thereon. In this way, the device according to an embodiment of the invention can be quickly and easily mounted on the spray gun or dismounted again from the spray gun, to be used as required, without the spray gun itself having to be changed.

Another measure of the present invention proposes that the extension rod of the device according to an embodiment of the invention is composed of a plurality of parts and can be adjusted in length telescopically by a locking or clamping mechanism. This measure allows the device to be easily adapted to the height of the operator and to the geometric dimensions of the surface to be painted. In this respect, the clamping mechanism can be configured, for example, by a screw clamp; the locking mechanism can be configured by a ball catch mechanism in connection with locking holes arranged in a mutual axial spacing.

To make the handling of the device according to an embodiment of the invention easier, it is proposed that at least the extension rod consists of one or more light metal pipes, via which the spray gun is optionally also electrically earthed if an electrostatic painting operation is to be carried out. In addition to this, it is also conceivable to produce the extension rod out of a plastics material pipe and, in this case in order to allow an electrostatic painting operation, an electric conducting wire should be arranged in or on the plastics material extension rod to earth the spray gun.

A further measure of the present invention proposes that fitted on the handle of the arm holder is an operating switch which is connected to the operating switch of the spray gun by a Bowden cable in order to remotely actuate the operating switch of the spray gun from the arm holder. Instead of using a Bowden cable, it is also possible to use a rod assembly which runs on or in the extension rod.

To further facilitate the handling of the device according to an embodiment of the invention, it is proposed to attach a supporting sling which can be positioned around the operator's body at the end, associated with the spray gun, of the extension rod. Consequently, the weight of the device can be substantially absorbed by the supporting sling, thereby enabling the operator to guide the spray gun more easily along the surface to be painted. In addition to or instead of this, it is possible to provide laterally on the extension rod a retaining bracket, directed away from the extension rod, for guiding the extension rod with both hands.

BRIEF DESCRIPTION OF THE DRAWINGS

In the following, further measures will be described in more detail in conjunction with the description of a preferred embodiment of the invention on the basis of the drawing. The single FIGURE shows a schematic perspective view of a device for manually painting a large surface using a spray gun.

DETAILED DESCRIPTION

According to the FIGURE, a surface 1 (shown here only schematically) is painted manually using a spray gun 2. Connected to the spray gun 2 is a paint feed line 3 for feeding an enamel paint from a reservoir (not shown here) and also a pressure line 4, running parallel thereto, for providing compressed air. After manually actuating a lever-type operating switch 6 which is arranged on the handle piece 5 of the spray gun 2, the enamel paint, fed via the paint feed line 3, can be sprayed by compressed air via a spray head 7 to apply the enamel paint onto the surface 1 of the workpiece. In this embodiment, this takes place electrostatically.

To manually move the spray gun 2 along the surface 1, a special extension rod 8 is provided, the front end of which is attached to the handle piece 5 of the spray gun 2. The extension rod 8 is attached to the handle piece 5 by a clip-shaped fastening unit 9 which surrounds the handle piece 5 of the spray gun 2 and is attached thereto in a detachable manner.

Formed on the end, opposite the fastening unit 9, of the extension rod 8 is an arm holder 10 which extends along the forearm of an operator (not shown here) and beyond the distal end of the forearm so that the extension rod 8 acts as a type of extension of the operator's forearm.

The extension rod 8 has a handle 11, projecting vertically from the extension rod 8, in the region of the arm holder 10. At the end of the extension rod 8, the arm holder 10 also has an arm support 12 which substantially encompasses the operator's forearm.

The extension rod 8 comprises a plurality of parts and can be adjusted in length telescopically by a locking mechanism 13 to adapt the length of the extension rod 8 to the height of the operator and also to the geometric dimensions of the workpiece to be coated. The extension rod 8 consists of a light metal pipe which simultaneously also electrically earths the spray gun 2. Fitted at the end, associated with the spray gun 2, of the extension rod 8 is also a supporting sling 14 which can be positioned around the operator's body, only the device-side end of said sling 14 being schematically shown here.

Fitted to the handle 11 of the arm holder 10 is an operating switch 15 which is connected to the operating switch 6 of the spray gun 2 via a Bowden cable 16 in order to actuate said switch 6 from the arm holder 10.

The invention is not restricted to the embodiment described above. Modifications are also possible which are covered by the scope of protection of the following claims. Thus, for example, it is also possible to provide, as an alternative or in addition to the supporting sling 14, a retaining bracket directed away from the extension rod 8, for guiding the extension rod 8 with both hands. In addition, it is also possible to produce the extension rod 8 from a plastics material. If an electrostatic painting operation is to be carried out, an electrical conducting wire can be arranged externally on the plastics material pipe or inside said pipe for earthing purposes.

In addition, it should be mentioned that "comprising" does not exclude any other elements or steps and "one" or "a" does not exclude a plurality. It is also pointed out that features or steps which have been described with reference to one of the above embodiments can also be used combined with other features or steps of other embodiments described above. Reference numerals in the claims should not be construed as limiting the scope of the claims.

LIST OF REFERENCE NUMERALS

1 surface
2 spray gun
3 paint feed line
4 pressure line
5 handle piece
6 operating switch
7 spray head
8 extension rod
9 fastening unit
10 arm holder
11 handle
12 arm support
13 locking or clamping mechanism
14 supporting sling
15 operating switch
16 Bowden cable

The invention claimed is:

1. A device for manually painting a large surface comprising:

a spray gun connected to a paint feed line for the supply of an enamel paint and to a pressure line for the provision of compressed air, wherein the spray gun is configured, after the manual actuation of a first operating switch arranged on a handle piece, to spray the enamel paint by compressed air via a spray head to apply the enamel paint onto the surface, wherein the spray gun further comprises means configured to move the spray gun manually along the surface, wherein the means for manually moving the spray gun along the surface comprise an extension rod, wherein the spray gun is attached to a first end of the extension rod by the handle piece and wherein the extension rod is configured such that, when held by an operator on an arm holder configured at an opposite end, the extension rod extends from the elbow along the forearm of the operator and beyond the distal end of the forearm, further comprising a second operating switch fitted on the handle of the arm holder and connected to the first operating switch of the spray gun via a Bowden cable to remotely actuate said first operating switch from the arm holder.

2. The device according to claim 1, wherein the arm holder of the extension rod comprises a handle extending away from the extension rod in a substantially vertical direction, and wherein the handle comprises a second operating switch in mechanical connection with the first operating switch.

3. The device according to claim 1, wherein the arm holder comprises at the end an arm support to at least partly surround the forearm of the operator.

4. The device according to claim 1, wherein the extension rod has on the end facing the spray gun a clip-shaped fastening unit for a releasable attachment to the handle piece of the spray gun.

5. The device according to claim 1, wherein the extension rod comprises a plurality of parts and is configured to be adjusted in length telescopically by a locking or clamping mechanism.

6. The device according to claim 1, wherein the extension rod comprises at least one light metal pipe electrically earthing the spray gun.

7. The device according to claim 1, wherein the extension rod comprises at least one plastics material pipe, and an electric conducting wire running in or on the pipe for earthing the spray gun.

8. The device according to claim 1, further comprising a supporting sling configured to be positioned around the operator's body and attached at the end, associated with the spray gun, of the extension rod.

9. The device according to claim 1, wherein the paint feed line and the pressure line are secured on the extension rod.

* * * * *